US009368032B1

(12) United States Patent
Sheikh

(10) Patent No.: US 9,368,032 B1
(45) Date of Patent: Jun. 14, 2016

(54) SYSTEM AND METHOD FOR LOCATING A VEHICLE WITHIN A PARKING FACILITY

(71) Applicant: Babak Sheikh, Weston, FL (US)

(72) Inventor: Babak Sheikh, Weston, FL (US)

( * ) Notice: Subject to any disclaimer, the term of this patent is extended or adjusted under 35 U.S.C. 154(b) by 0 days.

(21) Appl. No.: 14/249,312

(22) Filed: Apr. 9, 2014

(51) Int. Cl.
*G08G 1/123* (2006.01)
*G08G 1/13* (2006.01)

(52) U.S. Cl.
CPC ..... *G08G 1/13* (2013.01)

(58) Field of Classification Search
CPC ..... B60W 2050/008; B62D 15/0285; G06Q 10/02; G06Q 10/025; G06Q 10/06; G06Q 20/127; G06Q 50/12; E04H 6/14; G01C 21/20; G01C 21/206; G07B 15/04; G07F 17/0014; G07F 17/0057; G07F 17/24
USPC ..... 340/989, 5.2, 539.1, 539.11, 539.13, 340/539.22, 540, 5.64, 691.6, 691.1, 8.1
See application file for complete search history.

(56) References Cited

U.S. PATENT DOCUMENTS

| | | | | |
|---|---|---|---|---|
| 2007/0008129 | A1* | 1/2007 | Soliman | 340/572.1 |
| 2007/0270119 | A1* | 11/2007 | Dorogusker et al. | 455/343.5 |
| 2009/0091477 | A1* | 4/2009 | McCall et al. | 340/990 |
| 2009/0309759 | A1* | 12/2009 | Williams | 340/932.2 |
| 2013/0285855 | A1* | 10/2013 | Dupray et al. | 342/451 |
| 2014/0180972 | A1* | 6/2014 | Boldyrev et al. | 706/12 |

* cited by examiner

*Primary Examiner* — Daniel Previl
(74) *Attorney, Agent, or Firm* — Ronald V. Davidge

(57) ABSTRACT

A vehicle parked within a parking facility is found by first tracing a path from the vehicle to an entrance of the facility, using a portable electronic device that records data describing the path from movements of the device. Then, the path is retraced to return to the vehicle, with the device displaying a map of the path and a symbol indicating the current location of the device. Alternately, a portable radio beacon device is left in the vehicle to be turned on remotely by the portable electronic device, which then displays an indication of a direction from which signal from the beacon device is being received.

20 Claims, 6 Drawing Sheets

SYSTEM AND METHOD FOR LOCATING A VEHICLE WITHIN A PARKING FACILITY

RELATED APPLICATIONS

Not Applicable

FEDERALLY SPONSORED RESEARCH OR DEVELOPMENT

Not Applicable

BACKGROUND OF THE INVENTION

1. Field of the Invention

This invention relates to a system and method for finding an automobile parked within a parking facility and, more particularly to such a system and method that can be used without a requirement for specialized features or equipment within the parking facility.

2. Summary of the Background Information

A modern smartphone is typically provided with a conventional GPS (Global Positioning Satellite) receiver that can receive signals from multiple GPS SAsatellites and with a transceiver for sending and receiving radio-frequency signals through an access point that sends and receives data over the Internet. allowing the use of the smartphone in many locations and situations for navigation, including following roadways in a vehicle to reach a particular destination. It is additionally known that a conventional GPS receiver does not function properly in many indoor areas because of the attenuation of satellite signals by the walls and roofs of structures and because many elements within buildings cause reflections of the satellite signals and that the internal compass and accelerometers within a conventional smart phone can additionally used to generate location data. While methods adapted for specific locations, including the development of apps for particular shopping environments and the placement of multiple access points allowing the use of multiple access points, may be appropriate for stores and shopping centers, a method is needed to aid in the location of a parked automobile without requiring the use of systems installed within the parking facilities.

SUMMARY OF THE INVENTION

In accordance with a first aspect of the invention, a method is provided for finding a vehicle parked within a parking facility. The method comprises: a) carrying a portable electronic device through the parking facility along a path from the vehicle parked within the parking facility to an entrance of the parking facility to trace the path, with a microprocessor executing a local navigation program within the portable electronic device causes data, representing a current location of the portable electronic device, to be stored periodically within the portable electronic device; b) leaving the parking facility at the entrance of the parking facility; c) returning to the parking facility at the entrance of the parking facility, and d) carrying the portable electronic device through the parking facility along the path from the entrance of the parking facility to the vehicle parked within the parking facility, wherein the microprocessor executing the local navigation program causes a map of the path, generated from the data stored within the portable electronic device as the path was traced, along with a symbol representing the current location of the portable electronic device, to be displayed on a display within the portable electronic device.

Step a) may be preceded by providing a user selection indicating that a path is to be traced, with the method additionally comprising: e) providing a user selection indicating that a remote beacon device left in the parked vehicle is to be found, f) transmitting a first radio signal from the portable electronic device to the portable beacon device, causing the portable beacon device to transmit a beacon radio signal, g) carrying the portable electronic device within the parking facility as a symbol indication a direction for which the beacon signal is being received is indicated on a display screen of the portable electronic device, and h) timing off the beacon signal.

In accordance with a second aspect of the invention, a portable electronic device is provided. The portable electronic device comprises data storage; a selection interface providing user inputs, a horizontal motion detector for providing location data describing a current location of the portable electronic device relative to a horizontal plane, a display screen; and a microprocessor. The microprocessor is programmed to execute a local navigation app comprising steps of: i) receiving a user input from the selection interface, indicating a new path is to be traced; j) in response to step i) periodically determining a current location of the portable electronic device from data from the horizontal motion detector as the portable electronic device is moved along the new path and storing data representing the current position within the data storage; k) receiving a user input from the selection interface, indicating that the path is to be retraced from the entrance to the parking facility; l) displaying a map of the path on the display screen; and m) periodically determining a current location of the portable electronic device from data from the horizontal motion detector and displaying the current location on the map of the path. Additionally, the process of step j) may be ended in response to receiving a user input indicating that the entrance of the parking facility has been reached, and the process of step m) is ended in response to receiving a user input indicating that the vehicle has been reached.

Preferably, the horizontal motion detector comprises a portion of an internal guidance system and may additionally comprise a receiver for global positioning satellite (GPS) signals, and the local navigation app additionally includes steps of using output signals from the internal guidance system in response to receiving a user input from the selection interface indicating that the internal guidance system should be used and a step of using output signals from the receiver for GPS signals in response to receiving a user input from the selection interface indicating that GPS signals should be used. The local navigation app preferably additionally includes determining that the quality of output signals from the receiver for GPS signals is insufficient and using output signals from the internal guidance system.

Preferably, the portable electronic device additionally includes a vertical motion detector. Then, during step j), data is stored describing upward movement and the current location in the data storage when upward movement is detected by the vertical motion detector, and data is stored describing downward movement and the current location in the data storage when downward movement is detected by the vertical motion detector, and symbols representing the stored upward and downward movement are displayed during step m) The vertical motion detector may comprises a portion of an internal guidance system.

During step m), an upward movement symbol may be displayed when the current location of the portable is close to a location where, during step j), data describing an upward movement was stored, and a downward movement symbol is displayed when the current location of the portable is close to a location where, during step j), data describing an upward movement was stored. Alternately, when data describing vertical motion between floor levels at a particular location along the path has been stored in step b), a vertical motion symbol may be displayed on the map representing the particular location and symbols representing levels of floors are display at segments of the path extending from both sides of the vertical motion symbol, during step m). The symbols representing levels of floors may be changed by the user with the selection interface.

The portable electronic device may additionally comprise a directional antenna system including a plurality of antennas each having sensitivity in a different direction. Then the local navigation app additionally comprises steps of: n) receiving a user input from the selection interface, indicating that a direction to a remote beacon device is to be found; o) transmitting a first radio signal causing the remote beacon device to transmit a beacon radio signal; p) receiving the beacon radio signal and determining a direction from which the beacon radio signal is being received; q) displaying a symbol indicating the direction determined in step h) on the display screen; r) receiving a user input from the selection interface, indication that the remote beacon device has been reached. s) in response to receiving the user input in step i) stopping transmission of the first and beacon radio signals.

In accordance with a third aspect of the invention a system is provided, comprising a remote beacon device and a portable electronic device. The remote beacon device includes a receiver receiving a first radio signal and a transmitter transmitting a beacon radio signal. The portable electronic device includes a display, a transmitter, and a directional antenna system including a plurality of antennas each having sensitivity in a different direction. The portable electronic device performs steps comprising: t) receiving a user input indicating that a direction to a remote beacon device is to be found; u) transmitting the first radio signal causing the remote beacon device to transmit the beacon signal; v) receiving the beacon radio signal and determining a direction from which the beacon radio signal is being received; w) displaying an indication of the direction determined in step m) on the display screen; x) receiving a user input from the selection device, indication that the remote beacon device has been reached. and y) in response to receiving the user input in step i) stopping transmission of the first and beacon radio signals.

For example, in step v), the direction from which the signal is being received is chosen as one of two opposite directions indicated by the directional antenna system as providing a strongest signal level, which is closer to a direction in which the portable electronic device is pointed. Alternately, the portable electronic device may additionally include a device establishing a constant direction, such as a compass or a gyroscope, with, in step v), the direction from which the signal is being received is initially chosen as one of two opposite directions indicated by the directional antenna system as providing a strongest signal level, which is closer to a direction in which the portable electronic device is pointed, and subsequently chosen as one of the two opposite directions chosen to minimize a change in either direction in an angle between the cjpsem direction and the constant direction.

For example, the display of the portable electronic device may comprise a plurality of direction indicating lights, extending in a ring, with at least one of the direction indicating lights being illuminated to indicate the direction from which the signal is being received The display of the portable electronic device may additionally comprise an upward indicating light and a downward indicating light, with the upward indicating light being illuminated in response to determining that the beacon signal is being received primarily from an upward direction, and with the downward indicating light being illuminated in response to determining that the beacon signal is being received primarily from a downward direction A flashlight switch may be additionally provided so that a plurality of lights can be turned on, allowing the portable electronic device to be used as a flashlight.

The portable electronic device within the system may additionally include a selection interface for receiving various user inputs, with the portable electronic device additionally performing steps of i) receiving a user input from the selection interface, indicating a new path is to be traced; j) in response to step i) periodically determining a current location of the portable electronic device from data from the horizontal motion detector as the portable electronic device is moved along the new path and storing data representing the current position within the data storage; k) receiving a user input from the selection interface, indicating that the path is to be retraced from the entrance to the parking facility; l) displaying a map of the path on the display screen; and m) periodically determining a current location of the portable electronic device from data from the horizontal motion detector and displaying the current location on the map of the path. Additionally, the process of step j) may be ended in response to receiving a user input indicating that the entrance of the parking facility has been reached, and the process of step m) is ended in response to receiving a user input indicating that the vehicle has been reached.

BRIEF DESCRIPTION OF THE FIGURES

These and other aspects of the invention will be made apparent by reading the following specification in conjunction with the accompanying drawings, in which.

DETAILED DESCRIPTION OF THE INVENTION

Figure 1:
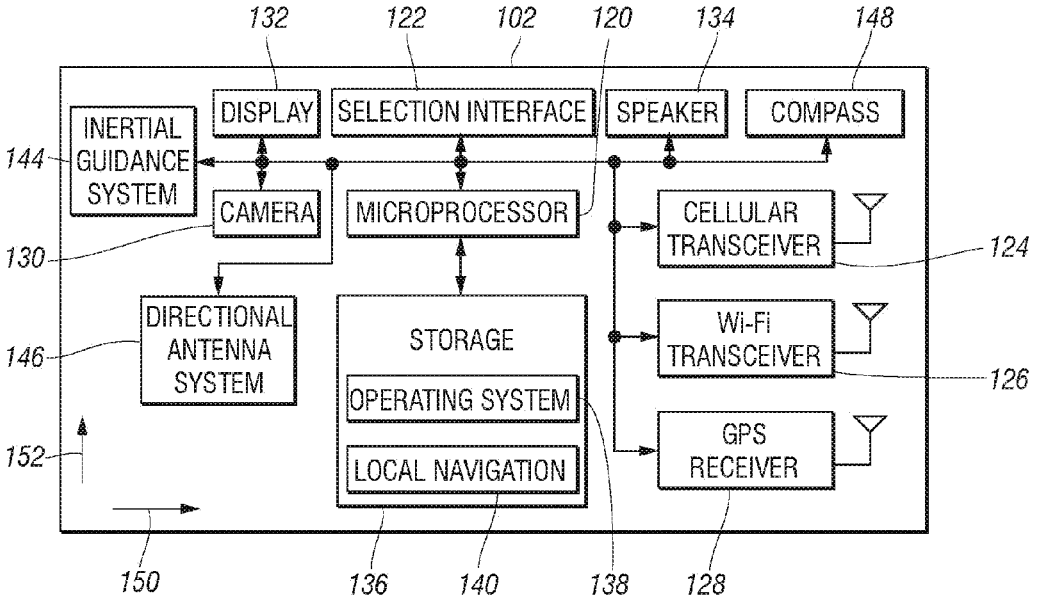
FIG. 1 is a schematic view of a portable electronic device configured in accordance with a first embodiment of the invention.

FIG. 1 is a schematic view of the portable electronic device 102, configured according to a first embodiment of the invention for operation as a conventional smartphone as well as for use in finding a vehicle within a parking facility. In particular, the portable electronic device 102 is configured to provide assistance in finding a vehicle in a parking facility without requiring the facility to install equipment providing information or facilitating communication within the facility, and without requiring the facility to be open to the sky to facilitate communications with GPS satellites. The portable electronic device 102 can be used to perform a trace and retrace method in which the user leaves a vehicle in a parking facility, and, carrying the portable electronic device with him, proceeds along a path of his own choosing to an entrance to the parking, while the path is traced by the portable electronic device 102, with data describing the path being stored therein. Subsequently, when the user returns to the parking facility to find his vehicle, he goes to the same entrance and causes the portable electronic device 102 to display a map of the traced path. As he then carries the portable electronic device along the path, a symbol indicating his current location is moved along the displayed path. Alternately, the user leaves a portable beacon device in the vehicle when it is parked within the parking facility, does not cause his path from the vehicle to be traced, but then, upon returning to the facility, causes the portable electronic device 102 to transmit a radio signal turning the portable beacon device on and to begin displaying the direction from which the beacon signal is being received.

The portable electronic device 102 includes a microprocessor 121 configured to receive inputs from a person using the portable electronic device 102 through a selection interface 122, to receive inputs developed from wireless signals received by a cellular transceiver 124, a Wi-Fi transceiver 126, and a GPS receiver 128, and additionally to receive an input from an internal camera 130. The microprocessor 121 is further configured to provide output signals driving a display 132 and a speaker 134 and to execute program instructions from apps stored within data and program storage 136. For example, the selection interface 122 may be one or more of a number of such devices that are well known to those skilled in the art of designing cellular phones, such as a keyboard with physical keys or a touch screen device used in conjunction with the display 132 to display keys and other images which are touched to provide inputs to the microprocessor 121. Data and instruction storage 136 includes an operating system 138, which is used by the microprocessor 120 to maintain data files, to run apps, and to operate various devices within or attached to the smartphone 103, and a local navigation app 140, which may, for example, have been downloaded particularly to help find a parked vehicle within a parking facility.

The portable electronic device 102 additionally includes an inertial guidance system 144 and a directional antenna system 146, both of which are particularly useful when performing navigation within a facility, such as an enclosed parking garage, restricting access to signals from GPS satellites. For example, the inertial guidance system 144 includes accelerometers measuring levels of acceleration along three mutually perpendicular axes and gyroscopes rotating about three mutually perpendicular axes, together providing a description of linear and angular movement of the portable electronic device 102 in three-dimensional space and a description of the direction of gravity, all relative to the portable electronic device 102 itself. One or more expressions for angular acceleration of the portable electronic device 102 may then be integrated to determine angular movement relative to a fixed horizontal direction. For example, the fixed horizontal direction may be established from the way the portable electronic device is held when the tracing or retracing of a path is started. Alternately, the portable electronic device 102 may include a compass 148 used to establish a fixed direction. The data describing the linear and angular movement of the portable electronic device 102 relative to itself, such as levels of acceleration along its longitudinal direction 150 and its transverse direction 152, may then be transformed into data describing the linear and angular movement relative to a fixed coordinate system, with mathematical integration being used to establish a current position of the portable electronic device 102. It is understood that devices and methods for using an internal guidance system to determine movement of an apparatus within three dimensional space is well known to those skilled in the art of designing and using navigation systems.

For example, the directional antenna system 146 includes three antennas, each of which is particularly sensitive to radio signals coming from a particular direction, with the three antennas being oriented so that the particular directions associated with them are mutually perpendicular. The relative strengths of the outputs of the three antennas is used to determine the direction from which the beacon signal is being received. If it is difficult or impossible to determine whether the radio signal is being received from a particular direction or from a direction 180 degrees from the particular direction, advantage will be taken of the fact that the user initially points the portable electronic device 102 inward, into the parking area, instead of outward, away from the parking area, with an angle between the direction from which the radio signal is being received and a constant direction established using the compass 148 or the inertial guidance system 146 changing only slowly as the portable electronic device 102 is moved toward the vehicle.

The portable electronic device 102 is thus considered to have a horizontal motion detector, detecting motion of the portable electronic device in a horizontal plane, and a vertical motion detector, detecting motion thereof in a vertical plane, both of which are differently constituted from elements described above in reference to FIG. 2, under various operating conditions, providing a flexibility that allows its use under varying types of conditions in various types of parking facilities. For example, the horizontal motion detector may operate using signals from the GPS receiver 128 or from a part of the inertial guidance system 102, while the vertical motion detector may operate using signals from another part of the inertial guidance system 144 or a part of the directional antenna system. A constant direction may be established using the compass 148 or the inertial guidance system 144. Preferably, the user holds the portable electronic device 102 level, but the inertial guidance system 144 can also be used to make corrections for changes in orientation. For example, microprocessor 120 executes a horizontal motion subroutine to determine horizontal movement of the portable electronic device 102 and a vertical movement subroutine to determine vertical movement thereof, with, both subroutines using signals provided by elements described in reference to FIG. 2.

Figure 2:
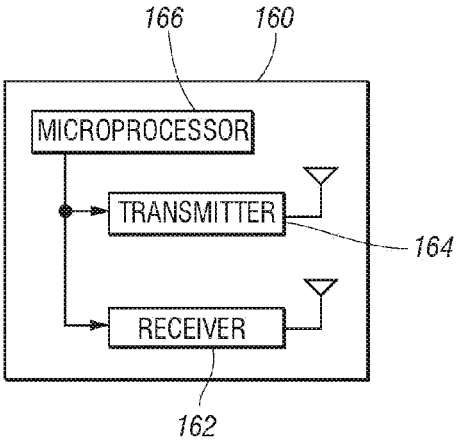
FIG. 2 is a schematic view of a portable beacon device configured for use with the portable electronic device of FIG. 1.

FIG. 2 is a schematic view of a portable beacon device 160, built for use with the portable electronic device 102 in accordance with the first embodiment of the invention, being left in a parked vehicle to transmit a radio signal that can be tracked to find the vehicle. The portable beacon device 160 includes a receiver 162, a transmitter 164 and a microprocessor 166 that controls the operation of the transmitter 164. For example, the portable beacon device 160 may be left in the parked vehicle to operate with power supplied either from the vehicle battery or from its own battery, being turned on and off by signals from the portable electronic device 102.

Figure 3:
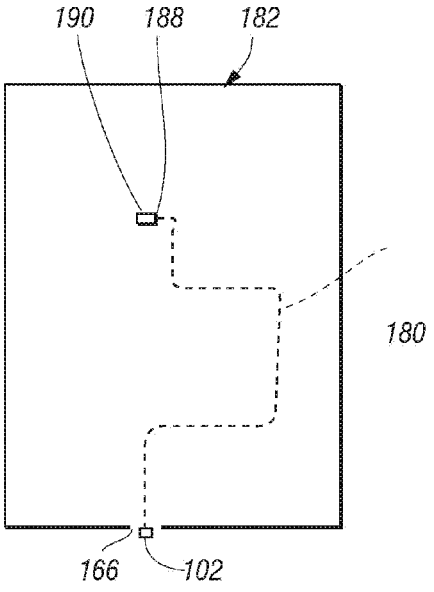
FIG. 3 is a schematic view showing the portable electronic device of FIG. 1 being used to navigate a path within a parking structure.

FIG. 3 is a schematic view showing the use of the portable electronic device 102 to navigate a path 180 within a parking facility 182. For example the path 180 starts at a starting point 184 at an entrance 186 to the parking facility 182 and ends at an end point 188 at a parked vehicle 190. The parking facility 182 may be open, allowing accurate navigation using GPS satellite signals, or it may be closed, with an alternate method of communication being provided according to the first embodiment of the invention. The parking facility 182 may include only a single level, or several parking levels being provided, with the path 180 including stairs, ramps, an elevator, etc.

As the terms are used herein, "parking facility" means the area in which the portable electronic device 102 is being used to find the vehicle 190, and the "entrance" is a place where this type of parting facility is entered. The "entrance" should be a place that can be easily found when the user returns, but it need not be a doorway into a parking structure.

Figure 4:
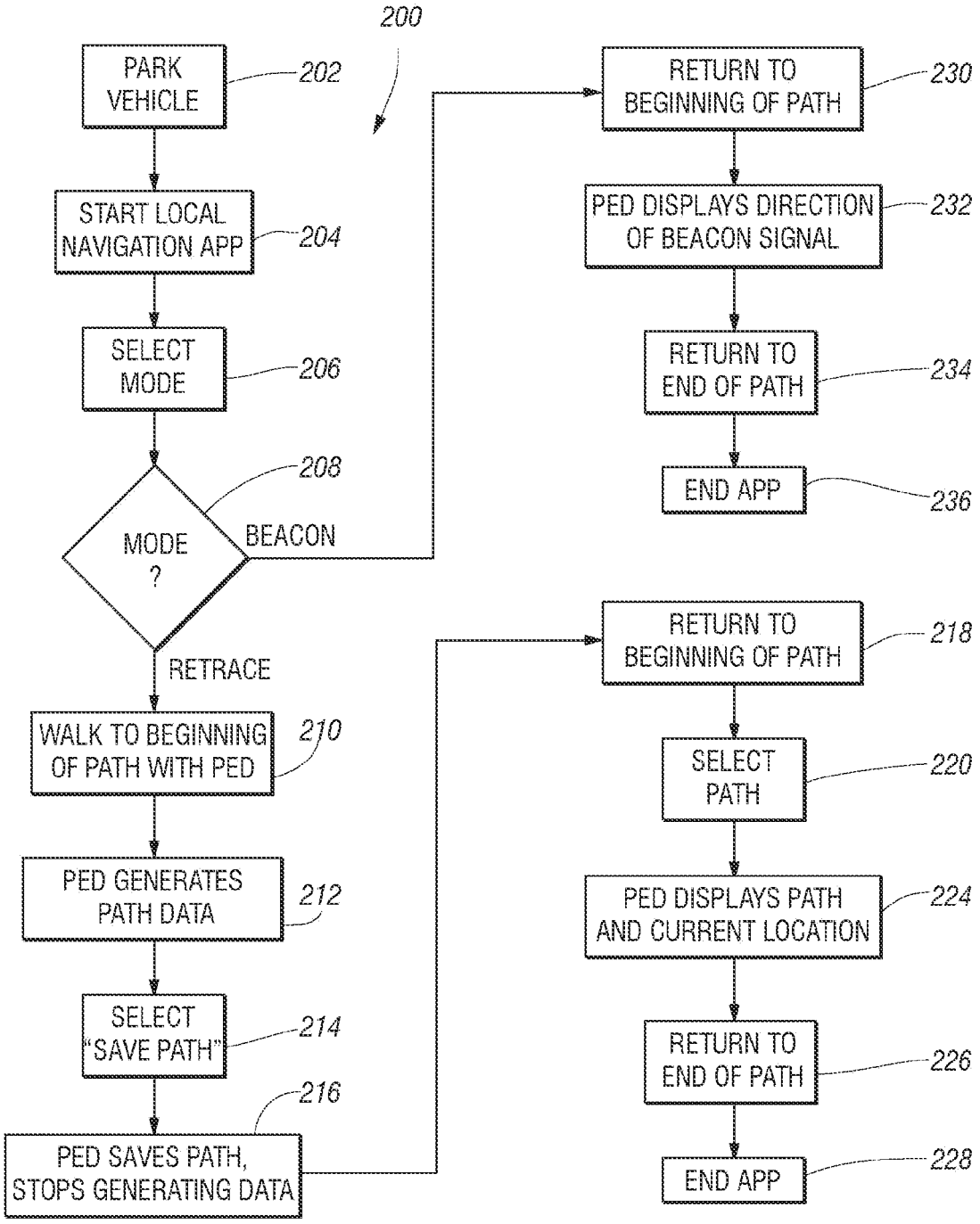
FIG. 4 is a flow chart showing a process occurring during use of the invention in accordance with the first embodiment of the invention.

FIG. 4 is a flow chart 200 showing a process occurring during use of the invention in accordance with the first embodiment of the invention. Referring to FIGS. 3 and 4, first, in step 202, the vehicle 190 is parked within the parking facility 182. Next, in step 204, the local navigation app 140 is started, displaying a main menu in step 206 to give the user an ability to choose one of several ongoing modes of operation. Then, in step 208, if the retrace mode has been selected, the user begins walking to the beginning of the path 180, which is defined herein as the point 186 at which the path 180 within the parking facility 182 begins, leading to an end 188 at the parked vehicle 190. The beginning of the path may be an entrance to the parking facility 182, an elevator leading from the parking facility 182, or any other point chosen by the user, to which he can later return. While the user walks to the beginning of the path 180 in step 212, the portable electronic device 102 performs measurements in step 214 to generate path data, describing the path 180 taken by the user at a number of points along the path 180. When the user reaches the beginning 186 of the path 180, he makes a menu selection in step 216, indicating that the path 180 should be saved. Then, in step 216, the data describing the path 180 is saved, and the generation of such data is stopped.

At this point, the user is ready to leave the parking facility 182, taking the portable electronic device 102 with him for use as a telephone or to use in finding objects within stores. After he returns, in step 218, to the beginning 186 of the path 180 within parking facility 182, the user selects the path 180 in step 220. For example, the path 180 within the parking facility 182 is selected from several paths stored within the portable electronic device 102. Then, in step 224, the path 180 is displayed and the current location are displayed by the portable electronic device 102. After the user finds his way to the parked vehicle 190, he ends operation of the local navigation app 140 by shutting the portable electronic device 102 off or by starting another app.

On the other hand, if it is determined in step 208 that the user has selected to use the beacon finding mode, the user leaves the portable beacon device 160 behind in the parked vehicle 190 but takes the portable electronic device 102 with him, for example, to use as a telephone or to use to find objects. After the user returns to the beginning 186 of the path 180, in step 230, he makes a selection in step 230 to indicate his arrival, causing the portable electronic device 102 to transmit a radio signal that, being received by the receiver 162 within the portable electronic beacon 160, causes the transmitter 164 therein to begin transmitting the beacon signal. Then, in step 232, the portable electronic device 102 begins displaying an indication of the direction from which the beacon signal is being received, allowing the user to follow the path 189 in step 234 to its end 188, at which the vehicle 190 has been left. Then, in step 236, the user ends operation of the local navigation app 140 by shutting the portable electronic device 102 off or by starting another app.

Figure 5:
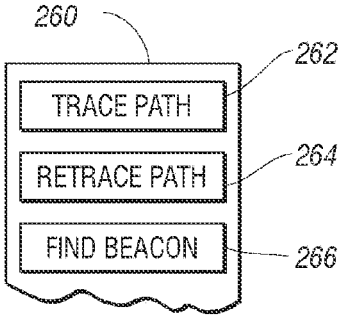
FIG. 5 is a fragmentary view of a main menu screen displayed on the portable electronic device of FIG. 1 during execution of the local navigation app.

FIG. 5 is a fragmentary view of a main menu screen 260 displayed on the display 132 of the portable electronic device 102 when the local navigation app is started, providing the user with an ability touch the TRACE PATH button 262, causing the local navigation app 140 to begin tracing a new path, from its end 188 at the parked vehicle 190 to its starting point 184 at the entrance 186. Alternately, the user can touch the RETRACE PATH button 264 for help retracing a path 180 which was previously traced, with data being stored, or the FIND BEACON button 266 to receive help in finding the portable beacon device 160, which has been left in the parked vehicle 190.

Figure 6:
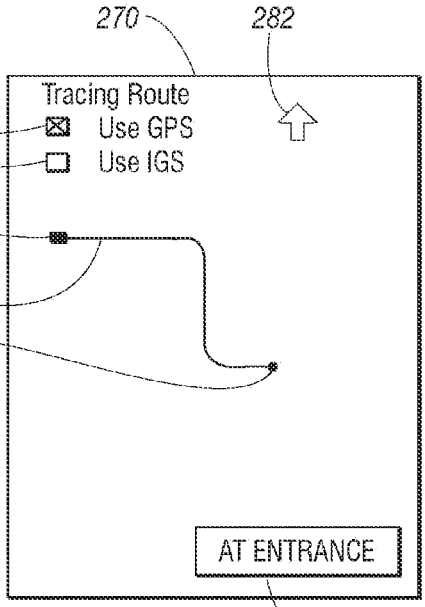
FIG. 6 is a view of a map screen displayed on the portable electronic device of FIG. 1 during the tracing of a route.

FIG. 6 is a view of a map screen 270 displayed on the portable electronic device 102 during operation during the trace mode, while a new path 180, shown in FIG. 3 and indicated on the map screen 270 by a line 272, from the vehicle 190, indicated on the map screen 270 by a symbol 274 to the entrance 166 is being developed. The line 272, extends to the present location of the portable electronic device 102, being elongated with movement of the portable electronic device 102, indicated by a symbol 273, along the path 180, which is determined by the user walking toward the entrance 166. When the user reaches the entrance 166, he touches a path termination button 276, causing the generation of data describing the path 180 stopped and causing this data to be stored for future use. The map screen 270 is shown as it would appear using navigational signals from GPS satellites to navigate the path 180, as indicated by an X-mark in the GPS box 278. The user can touch the IGS box 278 to begin operation using the inertial guidance system. While the path line 274 is shown as if viewed from above, preferably additional symbols, such as an upward-pointing arrow 282 are provided to show regions, such as stairways, elevators, or ramps where vertical movement occurs along the path 180.

Figure 7:
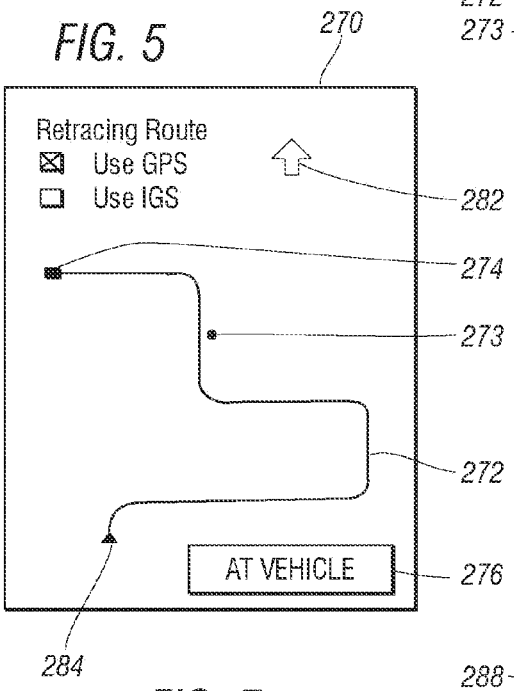
FIG. 7 is a view of a map screen displayed on the portable electronic device of FIG. 1 during the retracing of the route of FIG. 6.

FIG. 7 is a view of the map screen 270, shown with a previously traced path 180, indicated by the line 272, being retraced from the entrance 166, indicated by a symbol 284 to the vehicle 190, indicated by the symbol 274. The entire path line 272 is shown as previously determined, with the symbol 284 indicating the entrance 166.

Figure 8:
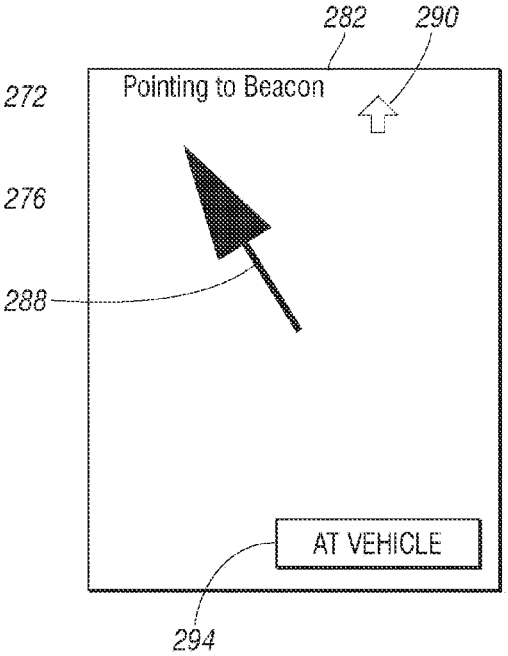
FIG. 8 is a view of a direction finding screen alternately displayed on the portable electronic device of FIG. 1.

FIG. 8 is a view of a beacon direction indicating screen 286 displayed on device 102 in response to an indication by the user that the direction from which a signal from the portable beacon device 160, shown in FIG. 2, that has been left behind in the vehicle 190, should be used to locate the vehicle 190. The beacon direction indicating screen 286 includes a horizontal direction indicating arrow 288 that points to the direction, in a horizontal plane, from which beacon signal appears to be arriving at the directional antenna system 146 within the portable electronic device 102. Preferably, a vertical directional arrow 290, pointing upward or downward, is additionally displayed if the beacon signal is determined to be coming from above or below the portable electronic device 102. A process termination button 294 is touched by the user to terminate the process when the vehicle 190 is reached.

Figure 9:
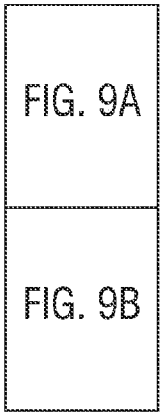
FIG. 9 is a flow chart showing steps occurring under control of a microprocessor within the portable electronic device of FIG. 1, during the execution of a local navigation app therein.
Figure 9A:
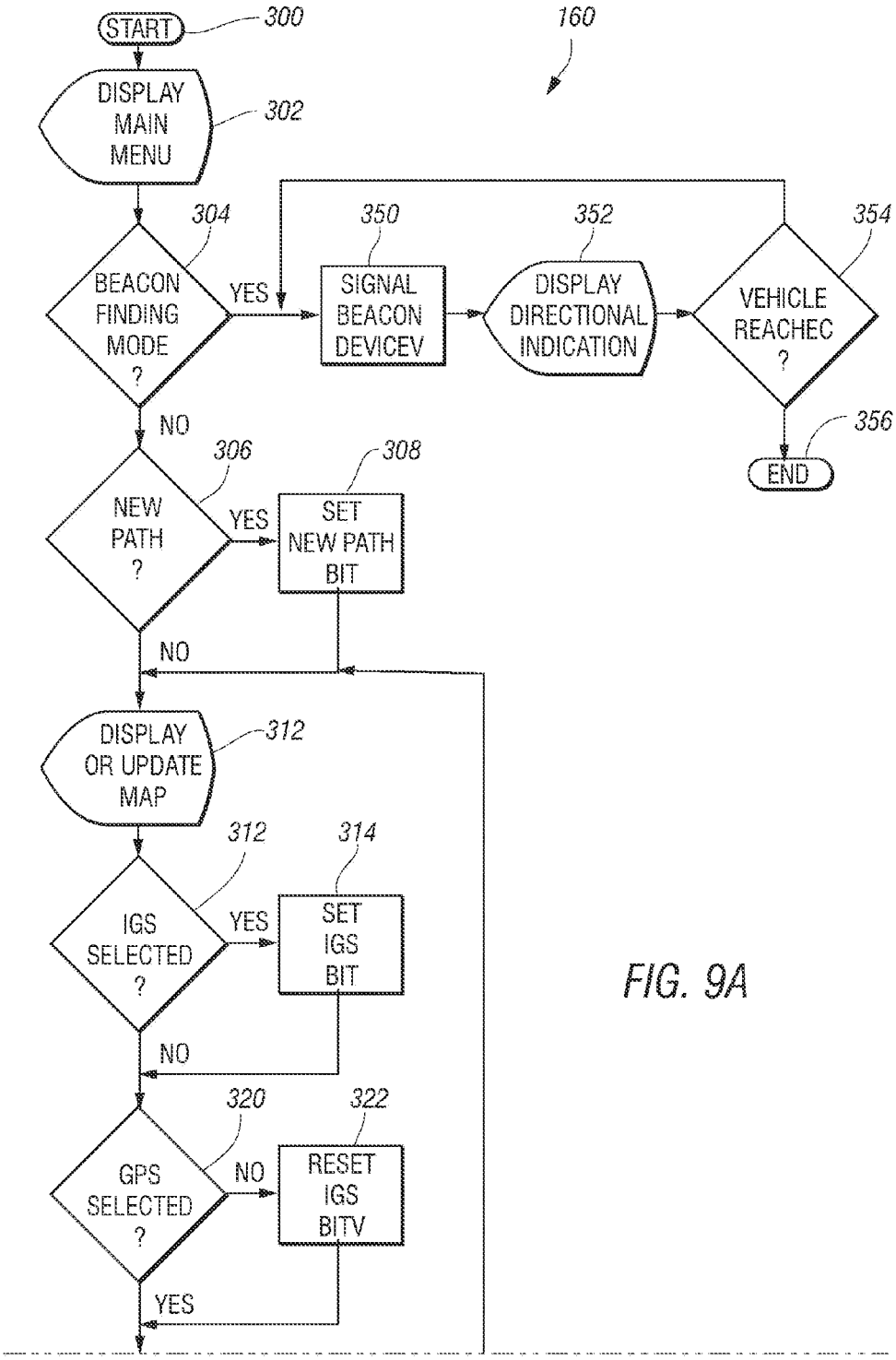
FIG. 9A is an upper portion of FIG. 9.
Figure 9B:
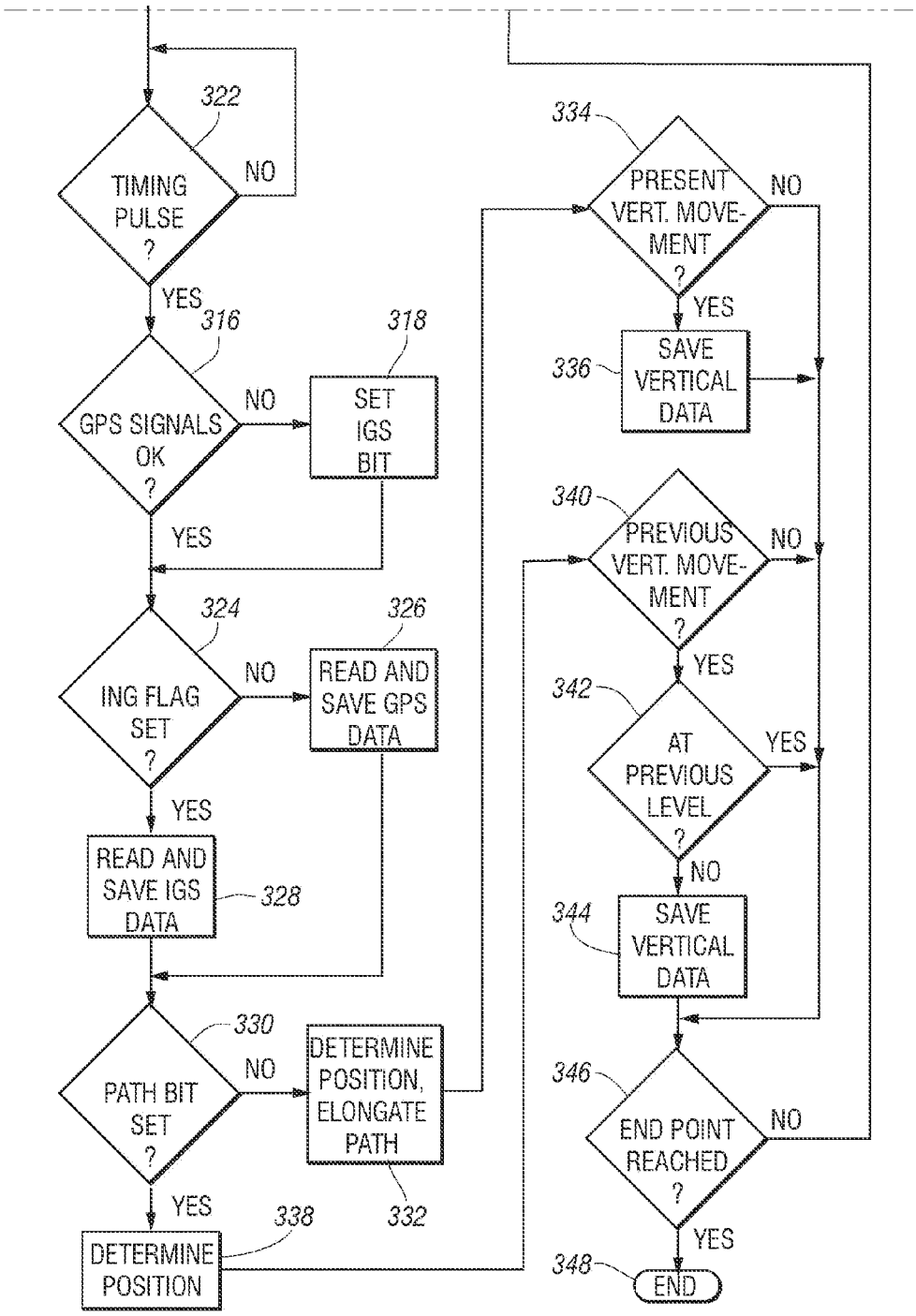
FIG. 9B is a lower portion of FIG. 9.

FIG. 9 is a flow chart showing steps occurring during the execution of the local navigation app 140 within the microprocessor 120 of the portable electronic device 102. FIG. 9 s divided into an upper portion, indicated as FIG. 9A, and a lower portion, indicated as FIG. 9B. After starting in step 300, the local navigation app 140 causes the main menu screen 260, shown in FIG. 5, to be displayed in step 302. If, for example, the user then touches the TRACE PATH button 262, it is determined in step 304 that the beacon finding mode has not been chosen, and in step 306 that a new path is to be traced, causing a new path flag bit to be set in step 308. Then, in step 310, the map screen 270 is displayed, as shown in FIG. 6.

For example, the local navigation app 140 uses GPS navigational signals unless it is determined in step 312 that the user has chosen, by touching the IGS box 280 on the map screen 270, to use the inertial guidance system 144, shown in FIG. 1, instead, causing an IGS flag bit to be set in step 314, or unless it is later determined in step 316 that the strength or quality of the GPS signals being received is insufficient, causing the IGS flag bit to be set in step 318. Similarly, if the user wishes to use GPS signals while the local navigation app 140 is using the inertial guidance system 144, he can press GPS box 278 on the map screen 270. When it is determined in step 320 that this is occurring, the IGS flag bit is reset to a zero level is step 322. The condition of the IGS flag bit is indicated by the "X" symbol within the boxes 278, 280. When the IGS flag bit has been set to a one level, this symbol is shown within the IGS box 280, but not within the GPS box 278. When the IGS flag bit has been s reset to a zero level, this symbol is shown within the GPS box 278, but not within the IGS box 280.

For example, the local navigation app 140 determines the current location of the portable electronic device 102 on a periodic basis, when a timing pulse is present, since it is not necessary to make this determination on a continuous basis. Thus, the local navigation app 140 waits at step 322 until a determination is made that the timing pulse is occurring, and then proceeds to determine if adequate GPS signals are being received in step 310, as explained above. Then, in step 324, it is determined whether the IGS flag bit has been set. If it has not been set, signals read through the GPS receiver 128 are used in step 326 to determine the current position of the portable electronic device 102. If the IGS flag has been set, signals from the inertial guidance system 144 are used to determine this current position in step 328.

In either case, the local navigation app 140 then proceeds to step 330, in which it is determined whether the new path flag bit has been set. If it has, a new path 180 is being traced by movement of the portable electronic device 102, so, in step 332, as data is provided to describe a new current location, the data describing this path 180 is modified to elongate this path 180 from the last location in which a measurement was made. Preferably, the inertial guidance system 146 is used to provide indications of vertical movement of the portable electronic device 102, with such movement occurring as the portable electronic device 102 is carried along a ramp, along a stairway, or within an elevator. Thus, if it is determined in step 334 that such vertical movement is occurring, vertical movement data, which at least indicates whether the movement is upward or downward, is saved in step 336. Data stored in steps 332 and 336 will be used to generate the map screen 270, as shown in FIG. 6, providing the with an indication that the displayed path 272 is being elongated with his movement, and, in instances where vertical movement is occurring, with verifications that it is being recognized. This data is also saved to provide a description of the path 180 in both horizontal and vertical directions for later use in retracing the path 180.

If it is determined in step 330 that the new path flag has not been set, it is understood that a previously defined path 180 is being retraced, with all of the data describing the path already stored within the portable electronic device 102, so that the only data stored in step 338 describes the current location of the portable electronic device 102, for subsequent use in displaying the relationship between the current location, as indicated by the symbol 273 on the map screen 270, as shown in FIG. 7, with the path 180, as shown by the line 272. Then, in step 340, a determination is made of whether the vertical movement occurred at a point near the current location when the path 180 now being retraced was originally traced. If it did occur, a further determination is made in step 342, by comparing data stored when the path 180 was originally traced with vertical movement data derived from the inertial guidance system 144, of whether the portable electronic device 102 should be moved upward or downward to reach the level at which it was previously held. If it is determined that such movement is needed, data is stored in step 344, so that an arrow 282, pointing upward or downward will be displayed within the map screen 270, as shown in FIG. 7.

The user determines when an end point of the path 180 has been reached, i.e. when the entrance 166 has been reached as the path 180 is traced, or when the vehicle 190 has been reached as the path 180 is retraced, and indicates that this determination has been made by touching the button 276 on the map screen 270. When it is determined in step 346 that this determination has been made, the tracing or retracing process ends, and the local navigation app 140 is allowed to close in step 348, for example by timing out or by being replaced with an app serving another purpose. Otherwise, the local navigation app 140 returns to step 310 to update the map screen 270 being displayed with recently saved data.

The user can determine to use a beacon signal from the portable beacon device 160, described above in reference to FIG. 2, left within his vehicle, to locate the vehicle by finding the direction from which the signal is being received by the directional antenna system 146 within the portable electronic device 102. For example, the user may recognize the parking facility 182 as being of a type in which the beacon finding method works best, or he may know that, after leaving the parking facility 182 at one of its ends, he will later return at the opposite end of the parking facility 182.

The user indicates a desire to use the beacon signal to find the vehicle 190 by touching the FIND BEACON button 266 in the main menu screen 260, shown in FIG. 5, as the main menu screen 260 is displayed in step 302 of the local navigation app 160. When it is then determined in step 304 that this has occurred, a signal is sent from the portable electronic device 102 to the portable beacon device 160 left behind in the vehicle 190, causing the portable beacon device 160 to begin transmitting the beacon signal. The relative signal strengths detected by the various individual antennas within the directional antenna system 148 of the portable electronic device 102 are then used to determine the apparent direction from which the signal is being sent, while the direction indicating screen 286 is displayed in step 352, with the apparent direction of origin of the beacon signal, in a horizontal plane, being displayed by the direction indicating arrow 288, and with a vertical directional arrow 290 additionally being displayed if it is determined that the signal is coming from above or below. This process continues until it is determined, in step 354, that the user has touched the termination button 294 on the direction indicating screen 286, causing the local navigation app to stop in step 356.

Since it is difficult to determine from measurements of the beacon signal whether the signal is coming from a particular direction or from a direction 180 degrees from the particular direction, advantage is taken of the fact that, as the user carries the portable electronic device 102 toward the portable beacon device 160, the angle between a direction extending to the portable beacon device 160 and a fixed direction changes, at most slowly. Thus, if the user holds the portable electronic device in a direction pointing generally toward the portable beacon device 160, there should be little trouble with following a direction 189 degrees from the direction to the portable beacon device 160 in error. Alternately, step 352 may be modified to include a process of determining a fixed angle using the compass 148 within the portable electronic device 102, determining which of two opposite directions is closer to an angle previously measured to the fixed angle, and causing the direction indicator 288 on the display screen 282 to point to the direction found to be closer.

For example, the transmission of a signal from the portable electronic device 102 to the portable beacon device 160 and the transmission of the beacon signal each occur on a periodic basis, with a signals being encoded, for example using various patterns of pulses or various frequencies, so that, even if a large number of vehicles including different portable beacon devices 160, each of the portable beacon devices 160 will respond only to a single portable electronic device 102 and so that a single portable electronic device 102 will respond only to a single portable beacon device 160.

As previously described, vertical movement data taken during the tracing of a path 180 has been saved to turn on an arrow 210, pointing upward or downward, as the user approaches, during the retracing of the path 180, the location at which the vertical movement occurred. Alternately, vertical movement may be quantified to determine levels of multiple floors along which the path extends.

While the portable electronic device 102 and the local navigation app 140 have been described as providing for the use of the beacon finding method, it is understood that a version of the first embodiment of the invention can be configured to provide only the trace and retrace method, for example with apparatus used only in the beacon finding method, such as the directional antenna system 146, not being provided within the portable electronic device, and with process steps used only in the selection and execution of the beacon finding method, such as steps 304, 350, 352 354 358 not being provided within the local navigation app.

Figure 10:
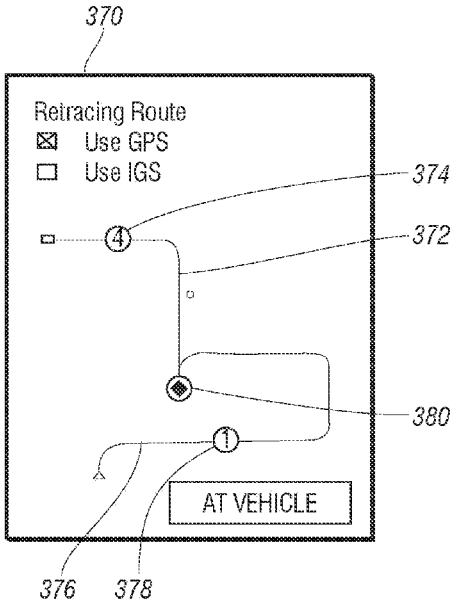
FIG. 10 is a view of an alternative map screen displayed on the portable electronic device of FIG. 1.

FIG. 10 is a view of an alternative map screen 370 showing a path divided into an upper portion 372, indicated by a displayed value 374 to extend along a fourth floor and a lower portion 376, indicated by a displayed value 378 to extend along a first floor. Preferably, the floor levels are determined using the inertial guidance system 144. A vertical movement symbol 380 indicates a location at which the vertical movement has occurred, such as a stairway, an elevator, or a ramp. Preferably, the user can also enter data at each of the displayed values 374, 378 to correct the levels displayed therein, using the selection interface 122 of the portable electronic device 102 after touching the map screen 370 at the value 374, 378 to be corrected. Data entered in this way is used to correct data entered using the inertial guidance system 144, correcting errors caused to differences in the distance between floor levels of various parking structures, and, for example, resetting the floor at the entrance to the parking area as the first floor. Alternately, in another version of the invention, floor levels may be entered manually in the absence of automatic entry.

Figure 11:
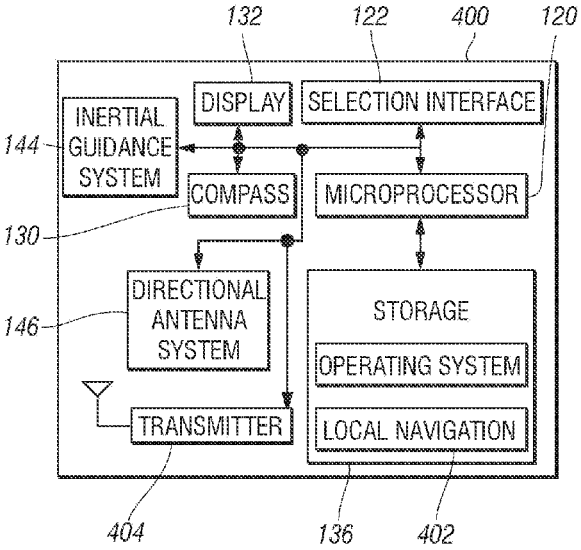
FIG. 11 is a schematic view of a portable electronic device configured in accordance with a second embodiment of the invention.

FIG. 11 is a schematic view of a portable electronic device 400, built in accordance with a second embodiment of the invention to be used for finding an automobile 190, in which the portable beacon device 190, described above in reference to FIG. 2, has been left, within a parking facility 182, shown in FIG. 3. The portable electronic device 400 includes a number of components that are similar to components of the portable electronic device 102, which have been described above in reference to FIG. 1, with such similar components being accorded like reference numbers. An alternative local navigation app 402 is stored within data storage 136 of the portable electronic device 400 for execution in accordance with the second embodiment. The portable electronic device 400 includes a transmitter 404 that transmits a radio signal causing the portable beacon device 160 to transmit a beacon signal.

Figure 12:
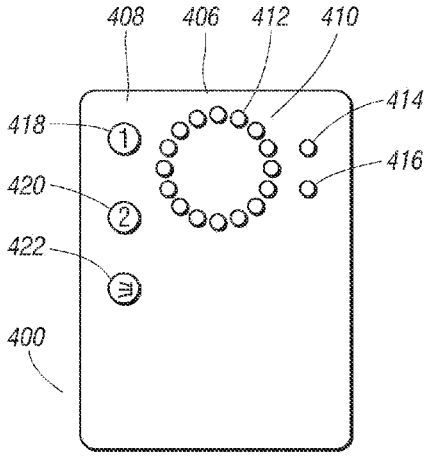
FIG. 12 is a plan view of the portable electronic device of FIG. 11.

FIG. 12 is a plan view of the portable electronic device 400, particularly showing indicator lights 406 that are used for displaying data and switches 408 that are used for controlling operation of the portable electronic device 400. For example, the indicator lights 406 include a ring 410 of direction indicating lights 412, an upward indicating light 414 and a downward indicating light 416, while the switches 408 include an on switch 418, an off switch 420 and a flashlight switch 422.

Figure 13:
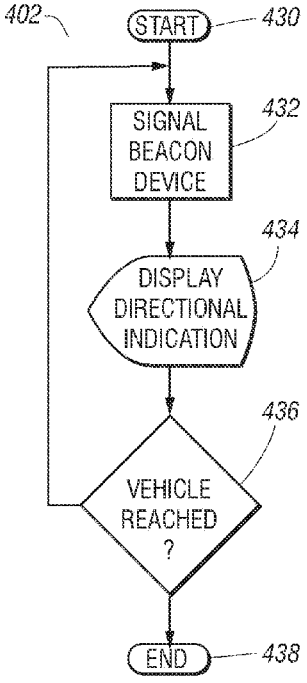
FIG. 13 is a flow chart showing steps occurring under control of a microprocessor within the portable electronic device of FIG. 11, during the execution of a local navigation app therein.

FIG. 13 is a flow chart showing steps occurring during the execution of the alternative local navigation app 402 in accordance with the second embodiment of the invention. After starting in step 430, the alternative local navigation app 402 proceeds to step 432, in which the transmitter 404 within the portable electronic device 400 begins transmitting a radio signal causing the portable beacon device 160 to begin transmitting a beacon signal. Each portable beacon device 160 and each portable electronic device 400 are preferably encoded to work only with one another in transmitting and receiving radio signals. Next, in step 434, the horizontal component of the direction from which the beacon signal is being received is indicated through the display, which is configured, for example, as described above in reference to FIG. 8 or as described above in reference to FIG. 12.

As described above in reference to FIG. 9, since it is difficult to determine from measurements of the beacon signal whether the signal is coming from a particular direction or from a direction 180 degrees from the particular direction, advantage is taken of the fact that, as the user carries the portable electronic device 102 toward the portable beacon device 160, the angle between a direction extending to the portable beacon device 160 and a fixed direction changes, at most slowly. Thus, if the user holds the portable electronic device in a direction pointing generally toward the portable beacon device 160, there should be little trouble with following a direction 189 degrees from the direction to the portable beacon device 160 in error. Alternately, step 432 may be modified to include a process of determining a fixed angle using the compass 148 within the portable electronic device 102, determining which of two opposite directions is closer to an angle previously measured to the fixed angle, and causing the direction indicator 288 on the display screen 282 to point to the direction found to be closer.

For example, if the user is relied upon to keep the portable electronic device 400 pointed toward the pointed toward the portable beacon device 160, two of the direction indicating lights 412 are illuminated, with the illuminated indicating lights 412 being spaced apart on the ring 410 by 180 degrees, and being together in alignment with the directions from which it has been determined, using the directional antenna system 146. Alternately, if the portable electronic device 400 additionally determines which of the two opposite directions indicated by the directional antenna system 146 is the correct one, for example by comparison with a fixed direction using the compass 148, a single directional indicating light 142 may be illuminated, along with a central light 440. It is further noted that a portable electronic device otherwise configured like the portable electronic device 400 may be provided with the display screen 282, described above in reference to FIG. 8, instead of with the arrangement of indicator lights 406.

This process continues, with measurements being made continuously or on a periodic basis, until it is determined in step 436 that he has pressed the off switch 422, indicating that the vehicle 190 has been reached and causing the local navigation app to stop in step 438.

While the invention has been described in terms of preferred embodiments with some degree of particularity, it is understood that this description has been given only by way of example, and that many changes can be made without departing from the spirit and scope of the invention, as defined in the appended claims.

What is claimed is:

1. A method for finding a vehicle parked within a parking facility, wherein the method comprises:

a) carrying a portable electronic device through the parking facility along a path from the vehicle parked within the parking facility to an entrance of the parking facility to trace the path, wherein a microprocessor executing a local navigation program within the portable electronic device causes data, representing a current location of the portable electronic device, to be stored periodically within the portable electronic device;

b) leaving the parking facility at the entrance of the parking facility;

c) returning to the parking facility at the entrance of the parking facility, d) carrying the portable electronic device through the parking facility along the path from the entrance of the parking facility to the vehicle parked within the parking facility, wherein the microprocessor executing the local navigation program causes a map, generated from the data stored within the portable electronic device as the path was traced, along with a symbol representing the current location of the portable electronic device, to be displayed on a display within the portable electronic device.

2. A method for finding a vehicle parked within a parking facility, wherein the method comprises:

a) determining whether a portable electronic device is to be used in a path tracing mode or in a beacon finding mode;

b) in response to determining in step a) that the portable electronic device is to be used in a path tracing mode, performing a process including the following steps c) through g);

c) providing a user selection indicating that a path is to be traced;

d) carrying a portable electronic device through the parking facility along a path from the vehicle parked within the parking facility to an entrance of the parking facility to trace the path, wherein a microprocessor executing a local navigation program within the portable electronic device causes data, representing a current location of the portable electronic device, to be stored periodically within the portable electronic device;

e) leaving the parking facility at the entrance of the parking facility;

f) returning to the parking facility at the entrance of the parking facility;

g) carrying the portable electronic device through the parking facility along the path from the entrance of the parking facility to the vehicle parked within the parking facility, wherein the microprocessor executing the local navigation program causes a map, generated from the data stored within the portable electronic device as the path was traced, along with a symbol representing the current location of the portable electronic device, to be displayed on a display within the portable electronic device;

h) in response to determining in step a) that the portable electronic device is to be used in a beacon finding mode, performing the following process including steps i) through l);

i) providing a user selection indicating that a remote beacon device left in the parked vehicle is to be found;

j) transmitting a first radio signal from the portable electronic device to the portable beacon device, causing the portable beacon device to transmit a beacon radio signal, k) carrying the portable electronic device within the parking facility as a symbol indication a direction for which the beacon signal is being received is indicated on a display screen of the portable electronic device, and l) turning off the beacon signal.

3. A portable electronic device comprising data storage; a selection interface providing user inputs, a horizontal motion detector for providing location data describing a current location of the portable electronic device relative to a horizontal plane, a display screen; and a microprocessor programmed to execute an app comprising steps of:

ai) receiving a user input from the selection interface, indicating a new path is to be traced;

aj) in response to step ai) periodically determining a current location of the portable electronic device from data from the horizontal motion detector as the portable electronic device is moved along the new path and storing data representing the current position within the data storage;

ak) receiving a user input from the selection interface, indicating that the path is to be retraced from the entrance to the parking facility;

al) displaying a map of the path on the display screen;

am) periodically determining a current location of the portable electronic device from data from the horizontal motion detector and displaying the current location on the map of the path.

4. The portable electronic device of claim 3, wherein the process of step aj) is ended in response to receiving a user input indicating that the entrance of the parking facility has been reached, and the process of step am) is ended in response to receiving a user input indicating that the vehicle has been reached.

5. The portable electronic device of claim 3, wherein the horizontal motion detector comprises a portion of an inertial guidance system.

6. The portable electronic device of claim 3, wherein the horizontal motion detector additionally comprises a receiver for global positioning satellite (GPS) signals, and the app additionally includes steps of using output signals from the internal guidance system in response to receiving a user input from the selection device indicating that the internal guidance system should be used and of using output signals from the receiver fir GPS signals in response to receiving a user input from the selection interface indicating that GPS signals should be used.

7. The portable electronic device of claim 3 wherein the horizontal motion detector additionally comprises a receiver for GPS signals, and the app additionally includes determining that the quality of output signals from the receiver for GPS signals is insufficient and using output signals from the internal guidance system.

8. The portable electronic device of claim 3, additionally comprising a vertical motion detector, wherein during step j) aj), data is stored describing upward movement and the current location in the data storage when upward movement is detected by the vertical motion detector, and data is stored describing downward movement and the current location in the data storage when downward movement is detected by the vertical motion detector, and symbols representing the stored upward and downward movement are displayed during step am).

9. The portable electronic device of claim 8, wherein the vertical motion detector comprises a portion of an internal guidance system.

10. The portable electronic device of claim 8, wherein during step ae), an upward movement symbol is displayed when the current location of the portable is close to a location where, during step b), data describing an upward movement was stored, and a downward movement symbol is displayed when the current location of the portable is close to a location where, during step ai), data describing an upward movement was stored.

11. The portable electronic device of claim 8, wherein, when data describing vertical motion between floor levels at a particular location along the path has been stored in step ab), a vertical motion symbol is displayed on the map representing the particular location and symbols representing levels of floors are display at segments of the path extending from both sides of the vertical motion symbol, during step am).

12. The portable electronic device of claim 11, wherein the symbols representing levels of floors can be changed by the user using the selection device.

13. A portable electronic device comprising data storage; a selection interface providing user inputs, a horizontal motion detector for providing location data describing a current location of the portable electronic device relative to a horizontal plane, a display screen, a directional antenna system including a plurality of antennas each having sensitivity in a different direction, and a microprocessor programmed to execute an app comprising steps of:

o) receiving a user input from the selection interface indicating a new path is to be traced and performing a process including the following steps p) through s):

p) periodically determining a current location of the portable electronic device from data from the horizontal motion detector as the portable electronic device is moved along the new path and storing data representing the current position within the data storage;

q) receiving a user input from the selection device, indicating that the path is to be retraced from the entrance to the parking facility;

r) displaying a map of the path on the display screen;

s) periodically determining a current location of the portable electronic device from data from the horizontal motion detector and displaying the current location on the map of the path;

t) receiving a user input from the selection interface indicating that a direction to a remote beacon device is to be found, and performing a process including the following steps o) through s):

o) u) transmitting a first radio signal causing the remote beacon device to transmit a beacon radio signal;

p) v) receiving the beacon radio signal and determining a direction from which the beacon radio signal is being received;

q) x) displaying a symbol indicating the direction determined in step h) on the display screen;

r) y) receiving a user input from the selection device, indication that the remote beacon device has been reached; and s) z) in response to receiving the user input in step i) stopping transmission of the first and beacon radio signals.

14. A system comprising a remote beacon device including a receiver receiving a first radio signal and a transmitter transmitting a beacon radio signal, and a portable electronic device including a display, selection interface for receiving inputs from a person using the portable electronic device, a transmitter, and a directional antenna system including a plurality of antennas each having sensitivity in a different direction, wherein the portable electronic device performs steps comprising:

at) receiving a user input from the selection interface indicating that a direction to a remote beacon device is to be found;

au) transmitting the first radio signal causing the remote beacon device to transmit the beacon signal;

av) receiving the beacon radio signal and determining a direction from which the beacon radio signal is being received;

aw) displaying an indication of the direction determined in step m) on the display screen;

ax) receiving a user input from the selection interface, indicating that the remote beacon device has been reached;

ay) in response to receiving the user input in step i) stopping transmission of the first and beacon radio signals.

15. The system of claim 14, wherein in step av, the direction from which the signal is being received is chosen as one of two opposite directions indicated by the directional antenna system as providing a strongest signal level, which is closer to a direction in which the portable electronic device is pointed.

16. The system of claim 14, wherein the portable electronic device additionally includes a device establishing a constant direction, and in step av), the direction from which the signal is being received is initially chosen as one of two opposite directions indicated by the directional antenna system as providing a strongest signal level, which is closer to a direction in which the portable electronic device is pointed, and subsequently chosen as one of the two opposite directions closer to minimize a change in either direction in an angle between the direction from which the signal is being received and the constant direction.

17. the system of claim 14, wherein the display of the portable electronic device comprises a plurality of direction indicating lights, extending in a ring, at least one of the direction indicating lights is illuminated to indicate the direction from which the signal is being received.

18. The system of claim 17, wherein the display of the portable electronic device additionally comprises an upward indicating light and a downward indicating light, the upward indicating light is illuminated in response to determining that the beacon signal is being received primarily from an upward direction, and the downward indicating light is illuminated in response to determining that the beacon signal is being received primarily from a downward direction.

19. The system of claim 17, additionally comprising a flashlight switch that turns a plurality of indicator lights on.

20. The system of claim 14, wherein the system additionally performs steps of:

i) receiving a user input from the selection device, indicating a new path is to be traced, j) in response to step i) periodically determining a current location of the portable electronic device from data from the navigation means as the portable electronic device is moved along the new path and storing data representing the current position within the data storage;

k) receiving a user input from the selection device, indicating that the path is to be retraced from the entrance to the parking facility;

l) displaying a map of the path on the display screen;

m) periodically determining a current location of the portable electronic device from data from the navigation means and displaying the current location on the map of the path.

* * * * *